US009243835B2

(12) United States Patent
Jeon et al.

(10) Patent No.: US 9,243,835 B2
(45) Date of Patent: Jan. 26, 2016

(54) REFRIGERATOR

(75) Inventors: Jeong Min Jeon, Suwon-si (KR); Kook Jeong Seo, Suwon-si (KR); Young Heon Kim, Suwon-si (KR); Yong Han Kim, Cheonan-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 724 days.

(21) Appl. No.: 13/584,270

(22) Filed: Aug. 13, 2012

(65) Prior Publication Data

US 2013/0037240 A1 Feb. 14, 2013

(30) Foreign Application Priority Data

Aug. 12, 2011 (KR) ..... 10-2011-0080441

(51) Int. Cl.
*F25D 11/02* (2006.01)
*F25D 21/04* (2006.01)

(52) U.S. Cl.
CPC ..... *F25D 21/04* (2013.01); *F25D 11/02* (2013.01); *F25D 2400/06* (2013.01)

(58) Field of Classification Search
CPC ... F25D 21/04; F25D 23/003; F25D 2400/10; F25D 11/022
USPC ..... 62/277, 440, 444, 447, 448
See application file for complete search history.

(56) References Cited

U.S. PATENT DOCUMENTS 3,835,660 A 9/1974 Franck
3,865,660 A * 2/1975 Lundstrom ..... 149/35
4,884,415 A * 12/1989 Mandel et al. ..... 62/277
5,255,531 A 10/1993 Williams et al.
6,056,383 A * 5/2000 Banicevic et al. ..... 312/406
6,266,970 B1 * 7/2001 Nam et al. ..... 62/277
6,393,855 B1 5/2002 Schuchert et al.
6,428,130 B1 * 8/2002 Banicevic et al. ..... 312/407

FOREIGN PATENT DOCUMENTS

EP 1079187 2/2001
KR 20-0376659 9/2000
KR 10-0554287 3/2001

OTHER PUBLICATIONS

Extended European Search Report issued Nov. 4, 2013 in European Patent Application No. 12180021.3.

* cited by examiner

*Primary Examiner* — Melvin Jones
(74) *Attorney, Agent, or Firm* — Staas & Halsey LLP

(57) ABSTRACT

Disclosed herein is a refrigerator. The refrigerator includes a main body including inner liners defining a freezer compartment and refrigerator compartment, doors rotatably coupled to the main body, gaskets installed at rears of the doors, each of the gaskets having a magnet provided therein, an intermediate partition wall formed by filling a space between the inner liners with an insulation material, an intermediate front plate disposed at a front of the intermediate partition wall to fix the inner liners, and a heat pipe installed at the front of the intermediate partition wall in a line to prevent dew from being formed on the intermediate front plate, wherein the intermediate front plate is formed in an asymmetric fashion so that the heat pipe installed at the front of the intermediate partition wall is fixed to a middle portion of the intermediate front plate in a tight contact fashion.

16 Claims, 6 Drawing Sheets

REFRIGERATOR

CROSS-REFERENCE TO RELATED APPLICATION(S)

This application claims the benefit of Korean Patent Application No. 2011-0080441, filed on Aug. 12, 2011 in the Korean Intellectual Property Office, the disclosure of which is incorporated herein by reference.

BACKGROUND

1. Field

Embodiments of the present invention relate to a refrigerator.

2. Description of the Related Art

Generally, a refrigerator is an appliance that stores foods in a frozen state or a refrigerated state using cool air generated by an evaporator constituting a refrigeration cycle.

The refrigerator includes a main body having a storage compartment to store foods and doors to open and close the storage compartment.

The doors are rotatably mounted to opposite sides of the main body to open and close the storage compartment.

The storage compartment includes a freezer compartment and refrigerator compartment. Inner liners defining the freezer compartment and refrigerator compartment are fixed by an intermediate front plate.

Between the inner liners defining the freezer compartment and refrigerator compartment is disposed an intermediate partition wall to partition the storage compartment into freezer compartment and refrigerator compartment.

A heat pipe is installed at the intermediate partition wall to prevent dew from being formed on the intermediate front plate due to temperature difference between the inside and outside of the storage compartment.

In a case in which the heat pipe installed at the intermediate partition wall is arranged in three lines, dew is effectively prevented from being formed on the intermediate front plate; however, heat is introduced into the storage compartment, thereby increasing energy consumption. On the other hand, in a case in which the heat pipe is arranged in a line, heat introduced into the storage compartment is reduced; however, contact between the heat pipe and intermediate front plate is low with the result that dew is formed on the intermediate front plate.

Consequently, there may be a necessity for a structure in which the heat pipe is arranged in a line with improved tight contact between the heat pipe and intermediate front plate.

SUMMARY

Therefore, it is an aspect of the present invention to provide a refrigerator wherein tight contact between a heat pipe and intermediate front plate is improved while heat introduced into a storage compartment is reduced, thereby preventing dew from being formed on the intermediate front plate.

Additional aspects of the invention will be set forth in part in the description which follows and, in part, will be obvious from the description, or may be learned by practice of the invention.

In accordance with one aspect of the present invention, a refrigerator includes a main body including inner liners defining a freezer compartment and refrigerator compartment, doors rotatably coupled to the main body to open and close the freezer compartment and refrigerator compartment, gaskets installed at rears of the doors to seal the main body and the doors, each of the gaskets having a magnet provided therein, an intermediate partition wall formed by filling a space between the inner liner defining the freezer compartment and the inner liner defining the refrigerator compartment with an insulation material, an intermediate front plate disposed at a front of the intermediate partition wall to fix the inner liner defining the freezer compartment and the inner liner defining the refrigerator compartment, and a heat pipe installed at the front of the intermediate partition wall in a line to prevent dew from being formed on the intermediate front plate, wherein the intermediate front plate is formed in an asymmetric fashion so that the heat pipe installed at the front of the intermediate partition wall is fixed to a middle portion of the intermediate front plate in a tight contact fashion.

The intermediate partition wall may be disposed between the inner liner defining the freezer compartment and the inner liner defining the refrigerator compartment to partition the freezer compartment and the refrigerator compartment from each other and may include an installation groove, in which the heat pipe is installed.

The intermediate partition wall may further include a plurality of tight contact members installed in the installation groove, in which the heat pipe is installed, to press the heat pipe so that the heat pipe is fixed to the intermediate front plate in a tight contact fashion.

The tight contact members installed in the installation groove may be disposed at predetermined intervals.

The heat pipe may be arranged at the front of the intermediate partition wall in a line to reduce introduction of external heat into the freezer compartment and the refrigerator compartment.

The heat pipe may be fixedly installed at the middle portion of the intermediate front plate so that the heat pipe is located between the gaskets installed at the rears of the doors.

The heat pipe may be installed so as to be located between the magnets provided in the gaskets.

The intermediate front plate may include a first tight contact part with which the gaskets are in tight contact, a second tight contact part with which the heat pipe is in tight contact, a coupling part coupled to the front of the intermediate partition wall, and a receiving part bent from the second tight contact part to receive the installation groove of the intermediate partition wall.

The intermediate front plate may be formed in an asymmetric fashion in which right and left side lengths of the second tight contact part are different from each other so that the installation groove of the intermediate partition wall is located at the middle portion of the intermediate front plate.

In accordance with another aspect of the present invention, a refrigerator includes a main body including a first inner liner defining a freezer compartment and a second inner liner defining a refrigerator compartment, a freezer compartment door and refrigerator compartment door rotatably coupled to the main body to open and close the freezer compartment and refrigerator compartment, respectively, gaskets installed at rears of the freezer compartment door and refrigerator compartment door to seal the main body and the freezer compartment door and refrigerator compartment door, an intermediate partition wall formed between the first inner liner and second inner liner to partition the freezer compartment and refrigerator compartment from each other, an intermediate front plate disposed at a front of the intermediate partition wall to fix the first inner liner and second inner liner, and a heat pipe installed at the front of the intermediate partition wall in a line to prevent dew from being formed on the intermediate front plate, wherein the intermediate partition wall comprises an installation groove, in which the heat pipe is installed, and the intermediate front plate is formed in an asymmetric fashion in which right and left side lengths of the second tight contact part, with which the heat pipe is in tight contact, are different from each other so that the heat pipe installed at the front of the intermediate partition wall is fixed to the middle portion of the intermediate front plate in a tight contact fashion.

The intermediate partition wall may further include a plurality of tight contact members installed in the installation groove, in which the heat pipe is installed, to press the heat pipe so that the heat pipe is fixed to the intermediate front plate in a tight contact fashion.

The tight contact members installed in the installation groove may be disposed at predetermined intervals.

The heat pipe may be arranged at the front of the intermediate partition wall in a line to reduce introduction of external heat into the freezer compartment and the refrigerator compartment.

The heat pipe may be fixedly installed at the middle portion of the intermediate front plate so that the heat pipe is located between the gaskets installed at the rears of the freezer compartment door and refrigerator compartment door.

The heat pipe may be installed so as to be located between magnets provided in the gaskets.

The intermediate front plate may include a first tight contact part with which the gaskets are in tight contact, a second tight contact part with which the heat pipe is in tight contact, a coupling part coupled to the front of the intermediate partition wall, and a receiving part bent from the second tight contact part to receive the installation groove of the intermediate partition wall.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
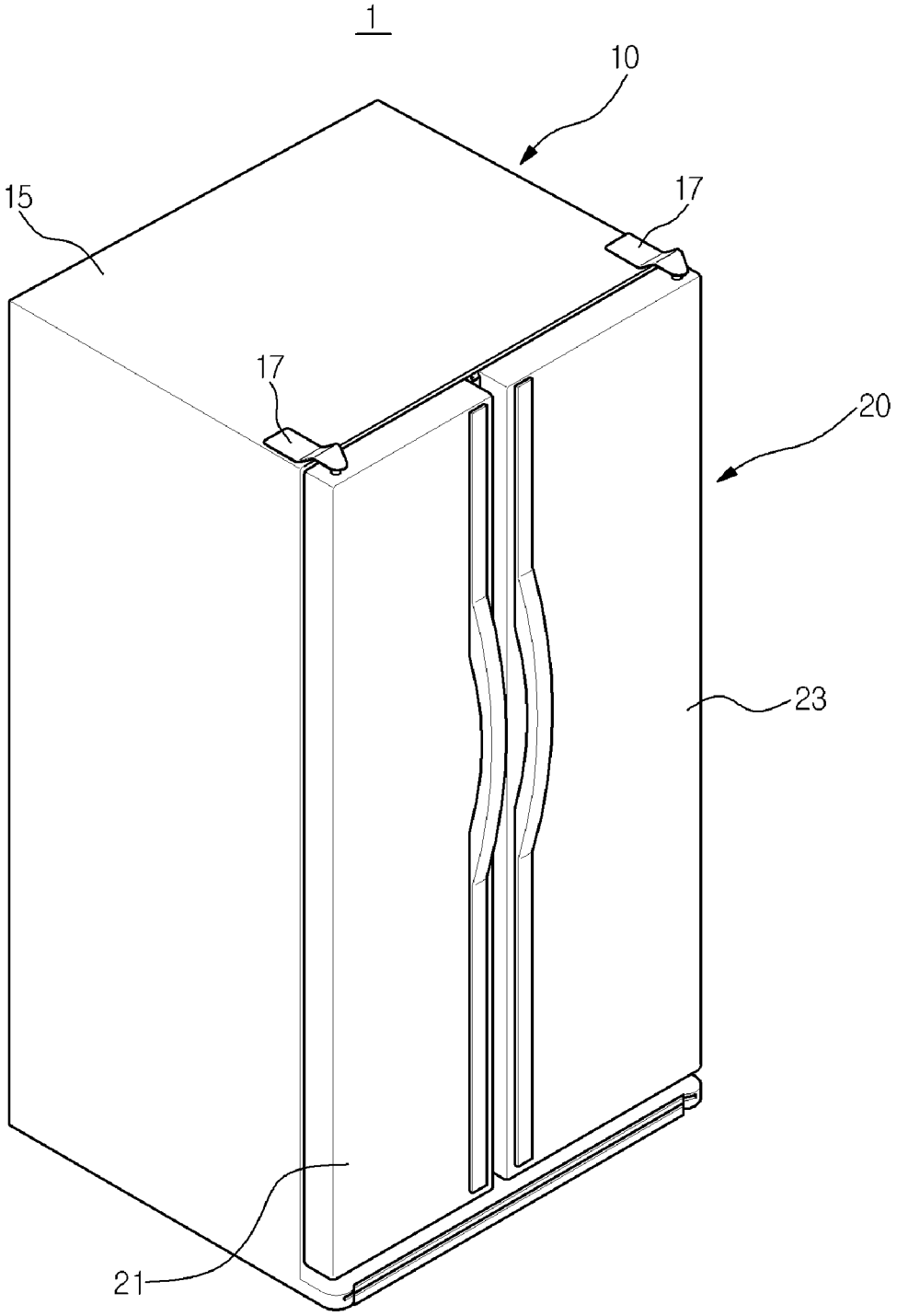
FIG. 1 is a perspective view of a refrigerator according to an embodiment of the present invention.

Reference will now be made in detail to the embodiments of the present invention, examples of which are illustrated in the accompanying drawings, wherein like reference numerals refer to like elements throughout.

Figure 2:
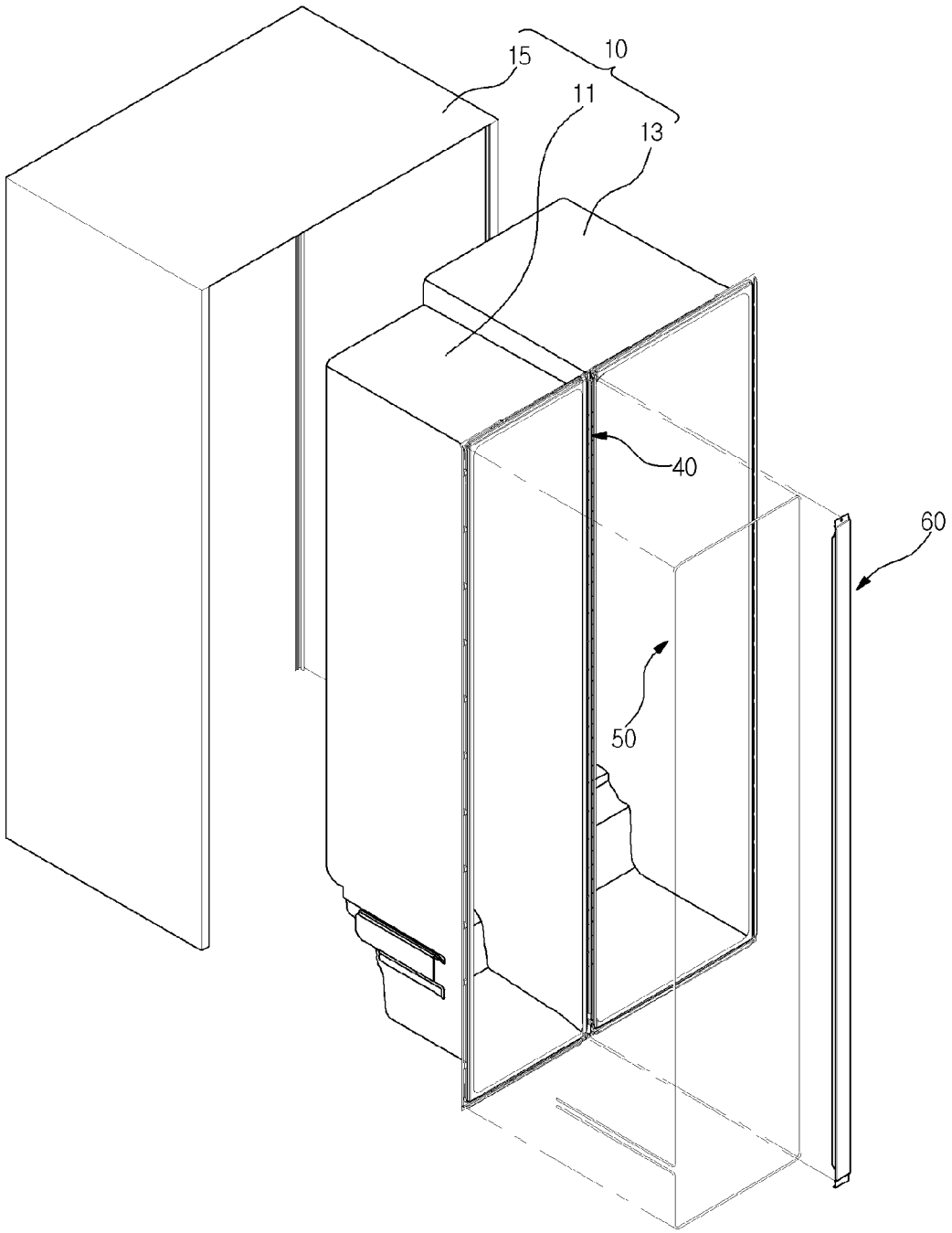
FIG. 2 is an exploded perspective view of the refrigerator according to the embodiment of the present invention.
Figure 3:
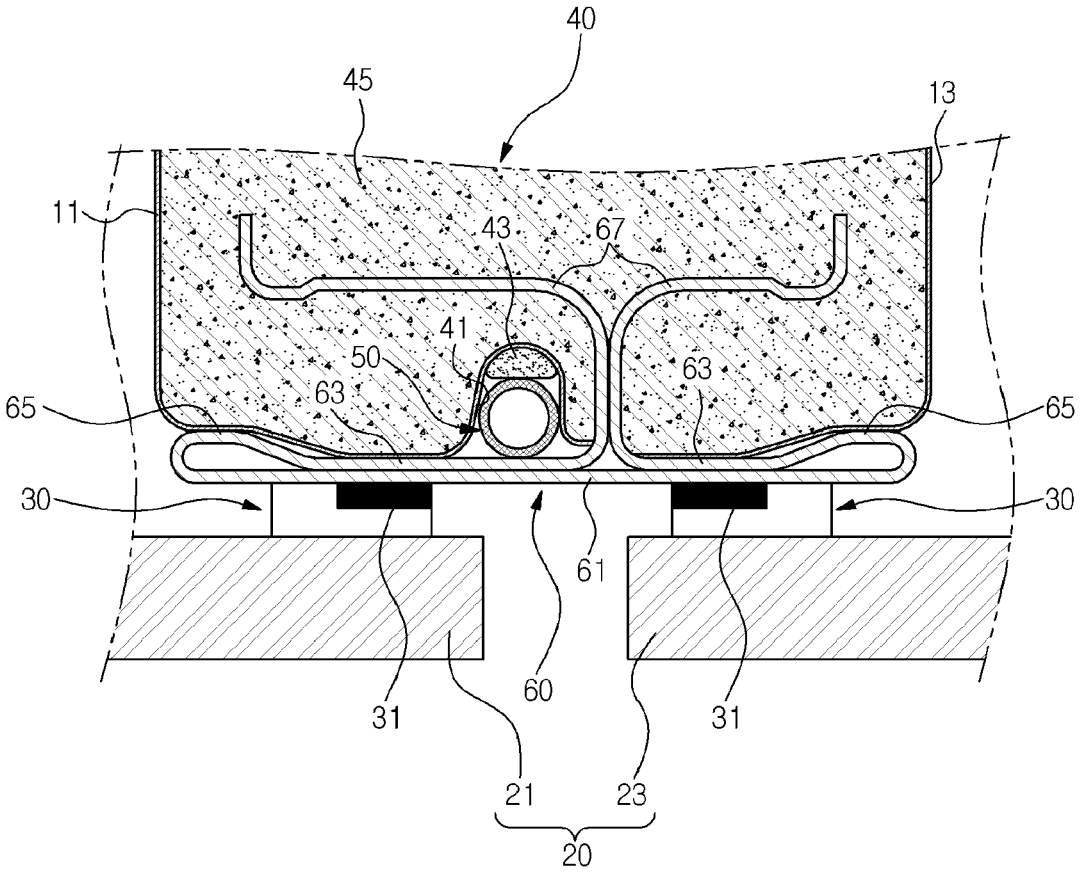
FIG. 3 is a view showing a heat pipe installation structure of the refrigerator according to the embodiment of the present invention.
Figure 4:
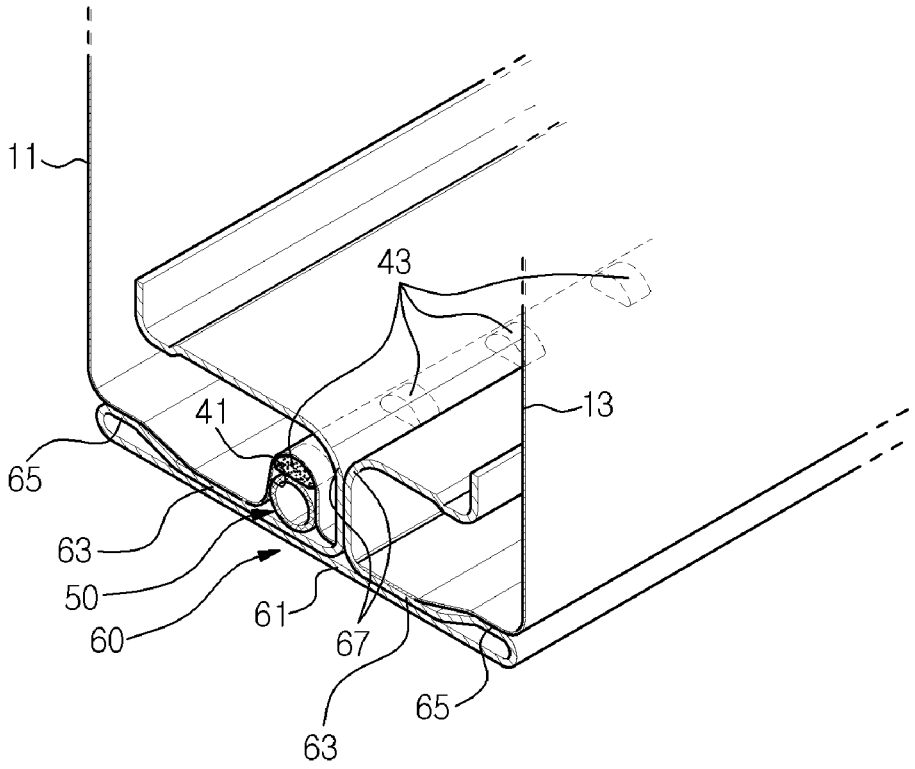
FIG. 4 is a perspective view showing the heat pipe installation structure of the refrigerator according to the embodiment of the present invention.

As shown in FIGS. 1 and 2, a refrigerator 1 includes a main body 10 forming the external appearance thereof and having a storage compartment to store foods defined therein, doors 20 rotatably coupled to the main body 10 to open and close the storage compartment, an intermediate partition wall 40 to partition the storage compartment into a freezer compartment and a refrigerator compartment, a heat pipe 50 installed at the front of the intermediate partition wall 40 to prevent dew from being formed on the intermediate partition wall 40, and an intermediate front plate 60 disposed at the front of the intermediate partition wall 40 to fix inner liners 11 and 13 defining the freezer compartment and refrigerator compartment, respectively. In the main body 10 are installed components constituting a refrigeration cycle, such as a compressor (not shown) to compress a refrigerant, a condenser (not shown) to cool the refrigerant through heat exchange between the refrigerant and air outside the main body, an expansion valve (not shown) to expand the refrigerant in a decompressed state, and an evaporator (not shown) to evaporate the refrigerant so that the refrigerant absorbs heat from air in the storage compartment to generate cool air. The cool air generated by the evaporator is supplied to the storage compartment so that the foods stored in the storage compartment are kept in a low temperate state.

At the lower rear side of the main body 10 is provided a machinery compartment (not shown), in which the compressor, condenser, and expansion valve are installed. At the rear side of the storage compartment is provided a cooling compartment (not shown), in which the evaporator is disposed.

The storage compartment is partitioned into right and left parts by the intermediate partition wall 40. One forms a freezer compartment to store foods in a frozen state, and the other forms a refrigerator compartment to store foods in a refrigerated state.

The main body 10 includes an outer liner 15 forming the external appearance thereof and inner liners 11 and 13 defining the storage compartment. A space between the outer liner 15 and the inner liners 11 and 13 is filled with an insulation material.

A major portion of the outer liner 15 is made of a metal material in consideration of durability, and the inner liners 11 and 13 are formed of a resin material in consideration of insulation and easy manufacture.

The inner liners 11 and 13 defining the storage compartment include a first inner liner 11 defining the freezer compartment and a second inner liner 13 defining the refrigerator compartment. The first inner liner 11 and the second inner liner 13 are fixed by the intermediate front plate 60. The intermediate partition wall 40 is disposed between the first inner liner 11 and the second inner liner 13 to partition the storage compartment into the freezer compartment and the refrigerator compartment.

The doors 20 are rotatably coupled to the main body 10 to open and close the storage compartment partitioned into the freezer compartment and the refrigerator compartment. The doors 20 include a freezer compartment door 21 to open and close the freezer compartment and a refrigerator compartment door 23 to open and close the refrigerator compartment.

One side upper end of each the doors 20 is rotatably coupled to one side upper end of the main body 10 by an upper hinge 17, and one side lower end of each of the doors 20 is rotatably coupled to one side lower end of the main body 10 by a lower hinge (not shown).

The intermediate front plate 60 is installed at the front of the intermediate partition wall 40 disposed between the first inner liner 11 and the second inner liner 13 to fix the first inner liner 11 defining the freezer compartment and the second inner liner 13 defining the refrigerator compartment. The heat pipe 50 is installed at the intermediate partition wall 40 in a line to prevent dew from being formed on the intermediate front plate 60 due to temperature difference between the inside and outside of the storage compartment.

Hereinafter, an installation structure of the heat pipe 50 in which the heat pipe 50 is disposed in a line, and tight contact between the intermediate front plate 60 and the heat pipe 50 is improved to prevent dew from being formed on the intermediate front plate 60 will be described in detail.

As shown in FIGS. 1 to 4, the refrigerator 1 includes a main body 10 including a first inner liner 11 defining a freezer compartment and a second inner liner 13 defining a refrigerator compartment, doors 20 including a freezer compartment door 21 rotatably coupled to the main body 10 to open and close the freezer compartment and a refrigerator compartment door 23 rotatably coupled to the main body 10 to open and close the refrigerator compartment, gaskets 30 installed at the rears of the freezer compartment door 21 and refrigerator compartment door 23 to seal the main body 10 and the doors 20, an intermediate partition wall 40 formed by filling a space between the first inner liner 11 and the second inner liner 13 with an insulation material, an intermediate front plate 60 disposed at the front of the intermediate partition wall 40 to fix the first inner liner 11 and the second inner liner 13, and a heat pipe 50 installed at the front of the intermediate partition wall 40 in a line to prevent dew from being formed on the intermediate front plate 60.

The gaskets 30 are installed at the rears of the freezer compartment door 21 and refrigerator compartment door 23. In each of the gaskets 30 is provided a magnet 31 to seal the main body 10 and the doors 20 including the freezer compartment door 21 and refrigerator compartment door 23.

The intermediate partition wall 40 is formed by filling a space between the first inner liner 11 and the second inner liner 13 with an insulation material 45. The heat pipe 50 and the intermediate front plate 60 are installed at the front of the intermediate partition wall 40.

The heat pipe 50 installed at the front of the intermediate partition wall 40 is arranged in a line. At the front of the intermediate partition wall 40 is formed an installation groove 41, in which the heat pipe 50 is installed.

In the installation groove 41, in which the heat pipe 50 is installed, is installed a plurality of tight contact members 43 to press the heat pipe 50 from the upper part of the installation groove 41 so that the heat pipe 50 is fixed in tight contact with the intermediate front plate 60.

The tight contact members 43 are disposed at predetermined intervals. The heat pipe 50 is fixed in tight contact with the intermediate front plate 60 by the tight contact members 43.

The heat pipe 50 is installed at the front of the first inner liner 11 defining the freezer compartment in a line. A portion of the heat pipe 50 is installed at the front of the intermediate partition wall 40 between the first inner liner 11 and the second inner liner 13.

The heat pipe 50 is connected to the condenser (not shown) of the refrigeration cycle to reduce the amount of heat introduced into the storage compartment and to prevent dew from being formed on the intermediate front plate 60 due to temperature difference between the inside and outside of the storage compartment.

To prevent dew from being formed on the intermediate front plate 60, the heat pipe 50 is in tight contact with the intermediate front plate 60.

In a case in which the heat pipe 50 is arranged in a line, the heat pipe 50 is in tight contact with the intermediate front plate 60 and, in addition, the heat pipe 50 is installed at the middle portion of the intermediate front plate 60 so that the heat pipe 50 is located between the gaskets 30 installed at the rears of the doors 20, to effectively prevent dew from being formed on the intermediate front plate 60.

Specifically, the heat pipe 50 is installed so as to be located between the gaskets 30 installed at the rears of the doors 20, particularly between the magnets 31 provided in the respective gaskets 30.

A structure of the intermediate front plate 60 in which the heat pipe 50 is installed at the middle portion of the intermediate front plate 60 will hereinafter be described.

The intermediate front plate 60 is disposed at the front of the intermediate partition wall 40 to fix the first inner liner 11 defining the freezer compartment and the second inner liner 13 defining the refrigerator compartment.

The intermediate front plate 60 includes a first tight contact part 61 with which the gaskets 30 installed at the rears of the doors 20 are in tight contact, a second tight contact part 63 with which the heat pipe 50 installed at the front of the intermediate partition wall 40 is in tight contact, a coupling part 65 coupled to the front of the intermediate partition wall 40, and a receiving part 67 bent from the second tight contact part 63 to receive the installation groove 41 formed at the intermediate partition wall 40.

The intermediate front plate 60 is formed in an asymmetric fashion in which right and left side lengths of the second tight contact part 63 are different from each other so that the heat pipe 50 installed at the front of the intermediate partition wall 40 in a line is located at the middle portion of the intermediate front plate 60, particularly between the magnets 31 provided in the gaskets 30 installed at the rears of the freezer compartment door 21 and refrigerator compartment door 23.

For the heat pipe 50 in tight contact with the second tight contact part 63 of the intermediate front plate 60 to be located at the middle portion of the intermediate front plate 60, the installation groove 41 of the intermediate partition wall 40, in which the heat pipe 50 is installed, is located at the middle portion of the intermediate front plate 60.

In a case in which the installation groove 41 of the intermediate partition wall 40 is located at the left side of the second tight contact part 63, with which the heat pipe 50 is in tight contact, so that the installation groove 41 of the intermediate partition wall 40 is located at the middle portion of the intermediate front plate 60, the left side length of the second tight contact part 63 is formed so as to be greater than the right side length of the second tight contact part 63 so that the installation groove 41 is received in the left side of the second tight contact part 63.

Figure 5:
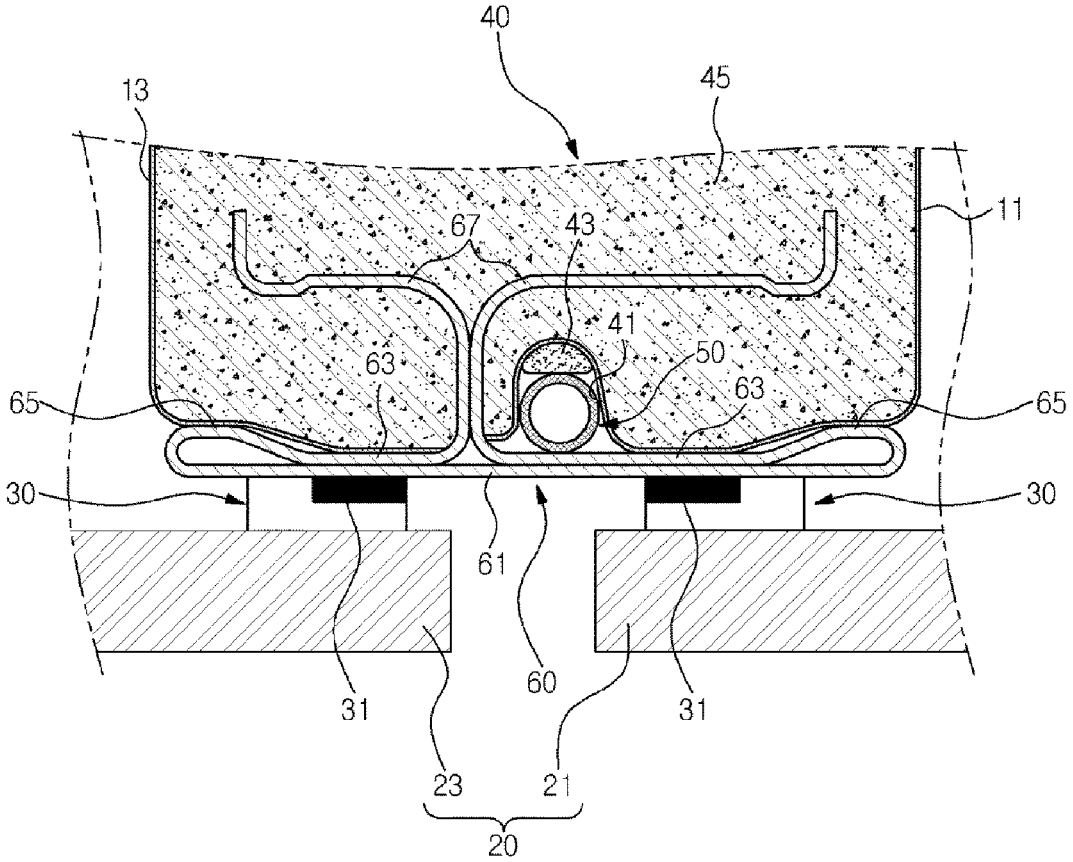
FIG. 5 is a view showing a heat pipe installation structure of a refrigerator according to another embodiment of the present invention.
Figure 6:
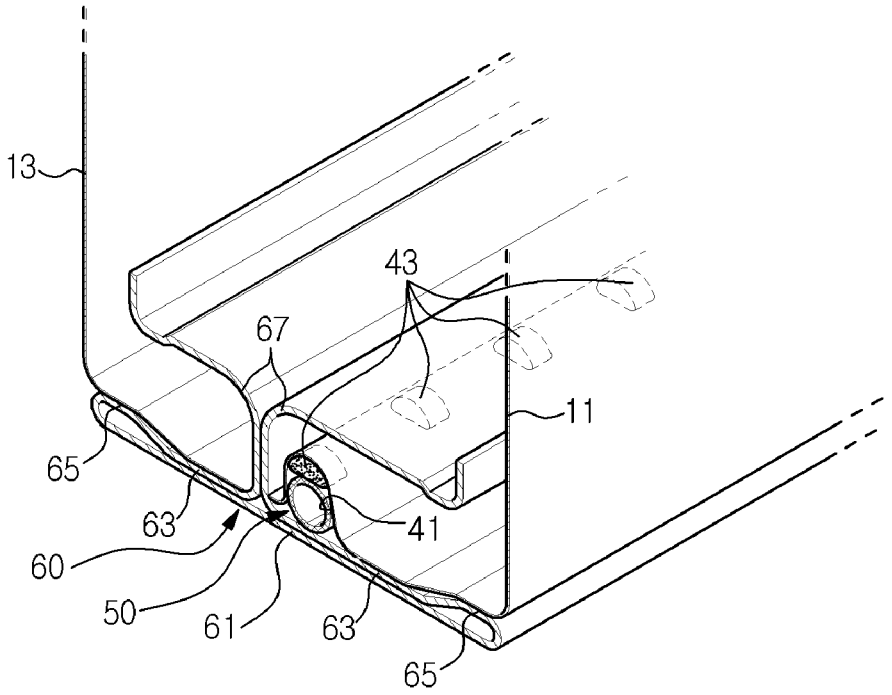
FIG. 6 is a perspective view showing the heat pipe installation structure of the refrigerator according to the embodiment of the present invention.

On the other hand, as shown in FIGS. 5 and 6, in a case in which the installation groove 41 of the intermediate partition wall 40 is located at the right side of the second tight contact part 63, with which the heat pipe 50 is in tight contact, the right side length of the second tight contact part 63 is formed so as to be greater than the left side length of the second tight contact part 63 so that the installation groove 41 is received in the right side of the second tight contact part 63.

As is apparent from the above description, the heat pipe minimizes the amount of heat introduced into the storage compartment, and tight contact between the intermediate front plate and the heat pipe is improved to prevent dew from being formed on the intermediate front plate.

Also, the heat pipe is arranged in a line, and therefore, the heat pipe is prevented from being twisted, sagging, and drooping, thereby improving working efficiency.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body comprising inner liners defining a freezer compartment and refrigerator compartment;

doors rotatably coupled to the main body to open and close the freezer compartment and refrigerator compartment;

gaskets installed at rears of the doors to seal the main body and the doors, each of the gaskets having a magnet provided therein;

an intermediate partition wall formed by filling a space between the inner liner defining the freezer compartment and the inner liner defining the refrigerator compartment with an insulation material;

an intermediate front plate disposed at a front of the intermediate partition wall to fix the inner liner defining the freezer compartment and the inner liner defining the refrigerator compartment; and a heat pipe positioned between the intermediate partition wall and the intermediate front plate to prevent dew from being formed on the intermediate front plate, wherein the intermediate front plate is formed in an asymmetric fashion so that the heat pipe installed at the front of the intermediate partition wall is fixed to a middle portion of the intermediate front plate in a tight contact fashion.

2. The refrigerator according to claim 1, wherein the intermediate partition wall is disposed between the inner liner defining the freezer compartment and the inner liner defining the refrigerator compartment to partition the freezer compartment and the refrigerator compartment from each other and comprises an installation groove, in which the heat pipe is installed.

3. The refrigerator according to claim 2, wherein the intermediate partition wall further comprises a plurality of tight contact members installed in the installation groove, in which the heat pipe is installed, to press the heat pipe so that the heat pipe is fixed to the intermediate front plate in a tight contact fashion.

4. The refrigerator according to claim 3, wherein the tight contact members installed in the installation groove are disposed at predetermined intervals.

5. The refrigerator according to claim 1, wherein the heat pipe is arranged at the front of the intermediate partition wall in a line to reduce introduction of external heat into the freezer compartment and the refrigerator compartment.

6. The refrigerator according to claim 5, wherein the heat pipe is fixedly installed at the middle portion of the intermediate front plate so that the heat pipe is located between the gaskets installed at the rears of the doors.

7. The refrigerator according to claim 6, wherein the heat pipe is installed so as to be located between the magnets provided in the gaskets.

8. The refrigerator according to claim 2, wherein the intermediate front plate comprises:

a first tight contact part with which the gaskets are in tight contact;

a second tight contact part with which the heat pipe is in tight contact;

a coupling part coupled to the front of the intermediate partition wall; and a receiving part bent from the second tight contact part to receive the installation groove of the intermediate partition wall.

9. The refrigerator according to claim 8, wherein the intermediate front plate is formed in an asymmetric fashion in which right and left side lengths of the second tight contact part are different from each other so that the installation groove of the intermediate partition wall is located at the middle portion of the intermediate front plate.

10. A refrigerator comprising:

a main body comprising a first inner liner defining a freezer compartment and a second inner liner defining a refrigerator compartment;

a freezer compartment door and refrigerator compartment door rotatably coupled to the main body to open and close the freezer compartment and refrigerator compartment, respectively;

gaskets installed at rears of the freezer compartment door and refrigerator compartment door to seal the main body and the freezer compartment door and refrigerator compartment door;

an intermediate partition wall formed between the first inner liner and second inner liner to partition the freezer compartment and refrigerator compartment from each other;

an intermediate front plate disposed at a front of the intermediate partition wall to fix the first inner liner and second inner liner; and a heat pipe positioned between the intermediate partition wall and the intermediate front plate to prevent dew from being formed on the intermediate front plate, wherein the intermediate partition wall comprises an installation groove, in which the heat pipe is installed, and the intermediate front plate is formed in an asymmetric fashion in which right and left side lengths of a tight contact part, with which the heat pipe is in tight contact, are different from each other so that the heat pipe is fixed to a middle portion of the intermediate front plate in a tight contact fashion.

11. The refrigerator according to claim 10, wherein the intermediate partition wall further comprises a plurality of tight contact members installed in the installation groove, in which the heat pipe is installed, to press the heat pipe so that the heat pipe is fixed to the intermediate front plate in a tight contact fashion.

12. The refrigerator according to claim 11, wherein the tight contact members installed in the installation groove are disposed at predetermined intervals.

13. The refrigerator according to claim 10, wherein the heat pipe is arranged at the front of the intermediate partition wall in a line to reduce introduction of external heat into the freezer compartment and the refrigerator compartment.

14. The refrigerator according to claim 13, wherein the heat pipe is fixedly installed at the middle portion of the intermediate front plate so that the heat pipe is located between the gaskets installed at the rears of the freezer compartment door and refrigerator compartment door.

15. The refrigerator according to claim 14, wherein the heat pipe is installed so as to be located between magnets provided in the gaskets.

16. The refrigerator according to claim 10, wherein the intermediate front plate comprises:

a first tight contact part with which the gaskets are in tight contact;

a second tight contact part with which the heat pipe is in tight contact;

a coupling part coupled to the front of the intermediate partition wall; and a receiving part bent from the second tight contact part to receive the installation groove of the intermediate partition wall.

* * * * *